US010053276B2

(12) United States Patent
Godet et al.

(10) Patent No.: US 10,053,276 B2
(45) Date of Patent: Aug. 21, 2018

(54) CONTAINER PROVIDED WITH A CURVED INVERTIBLE DIAPHRAGM

(71) Applicant: SIDEL PARTICIPATIONS, Octeville sur Mer (FR)

(72) Inventors: Florian Godet, Octeville sur Mer (FR); Ivan Pierre, Octeville sur Mer (FR)

(73) Assignee: SIDEL PARTICIPATIONS, Octeville sur Mer (FR)

( * ) Notice: Subject to any disclaimer, the term of this patent is extended or adjusted under 35 U.S.C. 154(b) by 0 days.

(21) Appl. No.: 15/318,537

(22) PCT Filed: Dec. 3, 2014

(86) PCT No.: PCT/EP2014/076343
§ 371 (c)(1),
(2) Date: Dec. 13, 2016

(87) PCT Pub. No.: WO2015/192918
PCT Pub. Date: Dec. 23, 2015

(65) Prior Publication Data

US 2017/0144817 A1 May 25, 2017

(30) Foreign Application Priority Data

Jun. 17, 2014 (EP) ..... 14305928

(51) Int. Cl.
*B65D 79/00* (2006.01)
*B65D 1/02* (2006.01)
*B65D 1/44* (2006.01)

(52) U.S. Cl.
CPC ..... *B65D 79/005* (2013.01); *B65D 1/0207* (2013.01); *B65D 1/0246* (2013.01); *B65D 1/0276* (2013.01); *B65D 1/44* (2013.01)

(58) Field of Classification Search
CPC .... B65D 79/005; B65D 1/0246; B65D 1/023; B65D 1/0207; B65D 1/02; B65D 1/0276;
(Continued)

(56) References Cited

U.S. PATENT DOCUMENTS 5,005,716 A * 4/1991 Eberle ..... B65D 1/0276 215/373
5,421,480 A * 6/1995 Cudzik ..... B65D 1/165 220/624

(Continued)

FOREIGN PATENT DOCUMENTS

CA 2 862 775 A1 8/2013

OTHER PUBLICATIONS

International Search Report, dated Feb. 9, 2015, from corresponding PCT Application.

*Primary Examiner* — Robert J Hicks
(74) *Attorney, Agent, or Firm* — Young & Thompson

(57) ABSTRACT

Container (1) made of a plastic material, provided with a base (7) including a standing ring (8) forming a support flange (9) and a diaphragm (11) extending from the standing ring (8) to a central portion (10), the diaphragm (11) being capable of standing in an outwardly-inclined position. The diaphragm (11) connects to the standing ring (8) at an outer junction (12) forming an outer articulation of the diaphragm (11). The diaphragm (11) connects to the central portion (10) at an inner junction (13) forming an inner articulation of the diaphragm (11). The diaphragm (11) is invertible with respect to the standing ring (8) from the outwardly-inclined position to an inwardly-inclined position. In the inwardly-inclined position, at least an inner portion (16) of the diaphragm (11) adjacent to the inner junction (13) is curved in radial section, with a concavity turned outwards.

16 Claims, 2 Drawing Sheets

(58) Field of Classification Search
CPC ..... B65D 1/0261; B65D 1/0223; B65D 1/44; B65D 1/42
USPC ..... 220/609, 608, 604, 624, 623, 610, 600; 215/373, 372, 371, 370, 381, 382, 376, 215/377, 374
See application file for complete search history.

(56) References Cited

U.S. PATENT DOCUMENTS

| | | | | |
|---|---|---|---|---|
| 2005/0194388 | A1* | 9/2005 | Dervy | B21D 22/30 220/608 |
| 2008/0047964 | A1 | 2/2008 | Denner et al. | |
| 2011/0204067 | A1 | 8/2011 | Schneider et al. | |
| 2013/0001235 | A1* | 1/2013 | Patcheak | B65D 1/0276 220/609 |
| 2013/0306588 | A1* | 11/2013 | Boukobza | B65D 1/0276 215/379 |
| 2014/0061211 | A1 | 3/2014 | Patcheak et al. | |
| 2014/0209558 | A1* | 7/2014 | Wright | B65D 79/005 215/376 |
| 2014/0291280 | A1* | 10/2014 | Miura | B65D 1/0276 215/374 |
| 2014/0319010 | A1* | 10/2014 | Derrien | B65D 21/0231 206/509 |
| 2015/0136725 | A1* | 5/2015 | Boukobza | B65D 1/0276 215/373 |
| 2016/0311599 | A1* | 10/2016 | Stelzer | B65D 79/005 |

* cited by examiner

CONTAINER PROVIDED WITH A CURVED INVERTIBLE DIAPHRAGM

FIELD OF THE INVENTION

The invention generally relates to the manufacturing of containers, such as bottles, which are produced by blow molding or stretch-blow molding from preforms made of plastic (mostly thermoplastic, e.g. PET) material. More specifically but not exclusively, the invention relates to the processing of hot-fill containers, i.e. containers filled with a hot pourable product (typically a liquid), the term "hot" meaning that the temperature of the product is greater than the glass transition temperature of the material in which the container is made. Typically, hot filling of PET containers (the glass transition temperature of which is of about 80° C.) is conducted with products at a temperature comprised between about 85° C. and about 100° C., typically at 90° C.

BACKGROUND OF THE INVENTION

U.S. Pat. Appl. No. 2008/0047964 (Denner et al, assigned to CO2PAC) discloses a container comprising a pressure panel located in the bottom portion of the container.

According to Denner, the pressure panel is movable between an outwardly-inclined position and an inwardly-inclined position to compensate for a change of pressure inside the container. In order to alleviate all or a portion of the vacuum forces within the container, the pressure panel is moved from the outwardly-inclined position by a mechanical pusher after the container has been capped and cooled, in order to force the pressure panel into the inwardly-inclined position.

Tests conducted on such a container showed that, once inverted to the inwardly-inclined position, the pressure panel does not maintain its position but tends to sink back under the pressure of the content. In the end, after the content has cooled, the container has lost much rigidity and therefore feels soft when held in hand. When stacking or palletizing the containers, there is a risk for the lower containers to bend under the weight of upper containers, and hence a risk for the whole pallet to collapse.

SUMMARY OF THE INVENTION

It is an object of the invention to propose a container having greater stability.

It is another object of the invention to propose a container provided with an invertible diaphragm capable of maintaining an inverted position.

It is therefore provided a container made of a plastic material, provided with a base including a standing ring forming a support flange and a diaphragm extending from the standing ring to a central portion, said diaphragm being capable of standing in an outwardly-inclined position, wherein the diaphragm connects to the standing ring at an outer junction forming an outer articulation of the diaphragm with respect to the standing ring;

wherein the diaphragm connects to the central portion at an inner junction forming an inner articulation of the diaphragm with respect to the central portion;

whereby said diaphragm is invertible with respect to the standing ring from the outwardly-inclined position, in which the inner junction extends below the outer junction, to an inwardly-inclined position in which the inner junction extends above the outer junction;

and wherein, in the inwardly-inclined position, at least an inner portion of the diaphragm adjacent to the inner junction is curved in radial section, with a concavity turned outwards with respect to the container.

The inner portion of the diaphragm provides rigidity in the inverted position, which prevents the diaphragm from sinking back. Pressure within the container is thereby maintained to a high value, providing high rigidity to the container.

According to various embodiments, taken either separately or in combination:

- in the inwardly-inclined position, an outer portion of the diaphragm adjacent to the outer junction is curved in radial section, with a concavity turned inwards with respect to the container;
- in the outwardly-inclined position, the diaphragm is curved in radial section, with a concavity turned outwards with respect to the container;
- the diaphragm has an outer diameter, measured on the outer junction and, in the outwardly-inclined position, a radius of curvature of the diaphragm is of about half the outer diameter of the diaphragm;
- the standing ring is a high standing ring provided with a frusto-conical inner wall a top end of which forms the outer junction, whereby in the outwardly-inclined position the central portion stands above the standing ring.
- the diaphragm has an inner diameter, measured on the inner junction, and an outer diameter, measured on the outer junction, such that their ratio is comprised between about 0.15 and about 0.45;
- the inner diameter and the outer diameter of the diaphragm are such that their ratio is of about 0.35;
- in the outwardly-inclined position, the diaphragm has an inner portion curved with a concavity turned outwards with respect to the container and having a radius of curvature, and an outer portion curved with a concavity turned outwards with respect to the container and having a radius of curvature smaller than the radius of curvature of the inner portion;
- the respective radiuses of curvature of the inner portion and outer portion of the diaphragm are such that their ratio is comprised between about 0.2 and 1;
- the outer portion of the diaphragm connects to the standing ring through an annular ring;
- the central portion has a central disc and a frustoconical outer ring which connects the inner portion of the diaphragm to the central disc, the outer ring being inclined, with respect to a line parallel to a main axis of the container, by an angle A, and, at the inner junction, the tangent to the inner portion of the diaphragm being inclined with respect to said line, in the outwardly-inclined position, by an angle B substantially equal to angle A.

The above and other objects and advantages of the invention will become apparent from the detailed description of preferred embodiments, considered in conjunction with the accompanying drawings.

DETAILED DESCRIPTION

Figure 1:
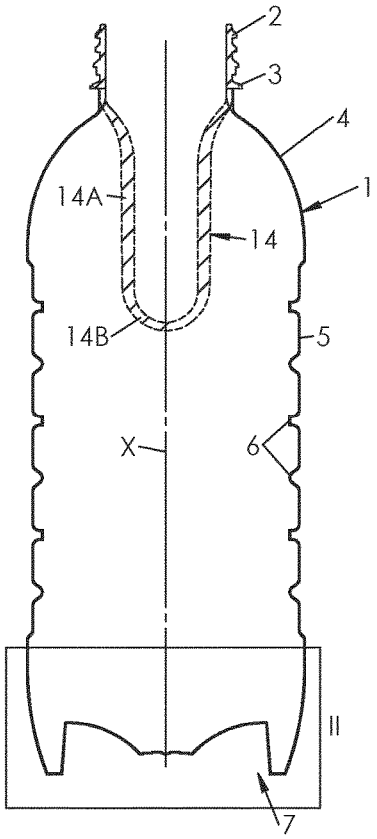
FIG. 1 is a sectional view showing both a preform (in dotted line) and a resulting container formed therefrom.

FIG. 1 shows a container 1 suitable for being filled with a product (such as tea, fruit juice, or a sports drink).

The container 1 includes an upper open cylindrical threaded upper portion or neck 2, which terminates, at a lower end thereof, in a support collar 3 of greater diameter. Below the collar 3, the container 1 includes a shoulder 4 which is connected to the collar 3 through a cylindrical upper end portion of short length.

Below the shoulder 4, the container 1 has a wall portion 5 which is substantially cylindrical around a container main axis X. The wall portion 5 may, as depicted on FIG. 1, include annular stiffening ribs 6 capable of resisting stresses which would otherwise tend to make the wall portion 5 oval when viewed in a horizontal section (such a deformation is standard and called ovalization).

At a lower end of the wall portion 5, the container 1 has a base 7 which closes the container 1 and allows the container 1 to be put on a planar surface such as a table.

The container base 7 includes a standing ring 8 which forms a support flange 9 extending in a plane substantially perpendicular to the main axis X, a central portion 10 and a diaphragm 11 extending from the standing ring 8 to the central portion 10.

The diaphragm 11 connects to the standing ring 8 at an outer junction 12 and to the central portion 10 at an inner junction 13. Both the outer junction 12 and the inner junction 13 are preferably curved (or rounded). The diaphragm 11 has an inner diameter D1, measured on the inner junction 13, and an outer diameter D2, measured on the outer junction 12.

The container 1 is blow-molded from a preform 14 (in dotted line in FIG. 1) including the unchanged neck 2, a cylindrical wall 14A and a rounded bottom 14B.

In a preferred embodiment depicted on the drawings, the standing ring 8 is a high standing ring, i.e. the standing ring is provided with a frusto-conical inner wall 15, a top end of which forms the outer junction 12 (and hence the outer articulation with the diaphragm 11.

The container 1 is blow-molded with the diaphragm 11 standing in an outwardly-inclined position in which the inner junction 13 is located below the outer junction 12 (the container 1 being held normally neck up).

Figure 2:
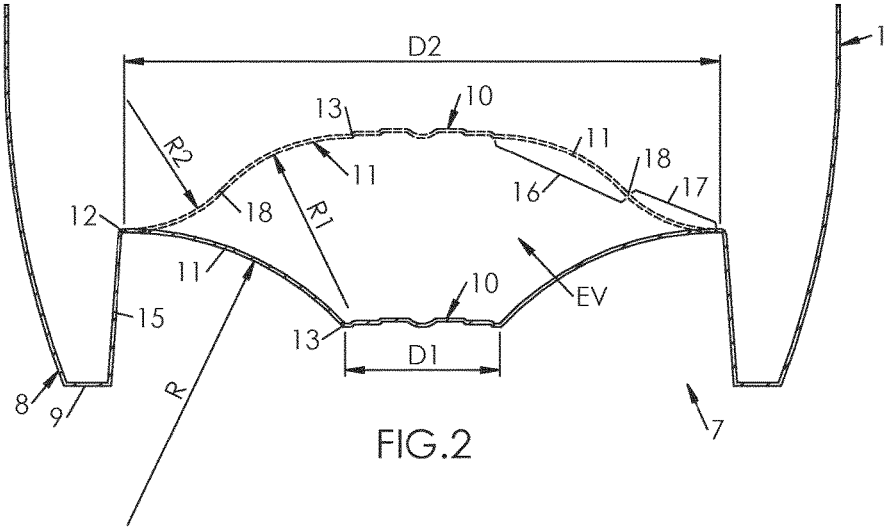
FIG. 2 is an enlarged sectional view showing the base of the container within the frame II of FIG. 1, both in an outwardly-inclined position of the diaphragm (in continuous line) and in an inwardly-inclined position thereof (in dotted line), according to a first embodiment.
Figure 3:
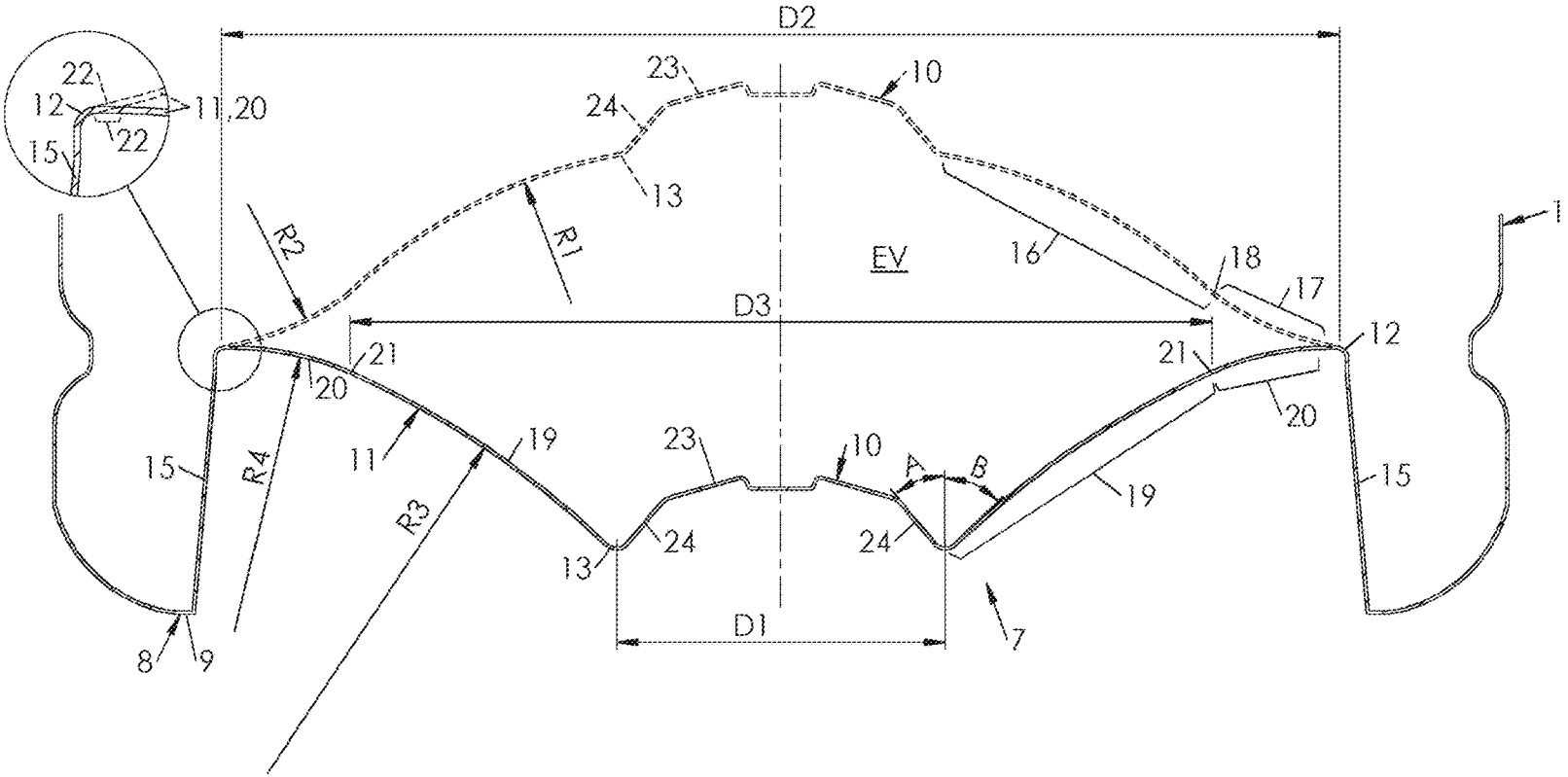
FIG. 3 is an enlarged sectional view similar to FIG. 2, showing the base of the container, both in an outwardly-inclined position of the diaphragm (in continuous line) and in an inwardly-inclined position thereof (in dotted line), according to a second embodiment.

The outer junction 12 forms an outer articulation of the diaphragm 11 with respect to the standing ring 8 and the inner junction 13 forms an inner articulation of the diaphragm 11 with respect to the central portion 10, whereby the diaphragm 11 is invertible with respect to the standing ring 8 from the outwardly-inclined position (in continuous line on FIG. 2 and FIG. 3) to an inwardly-inclined position wherein the inner junction 13 is located above the outer junction 12 (in dotted lines on FIG. 2 and FIG. 3).

Inversion of the diaphragm 11 may be achieved mechanically (e.g. with a pusher mounted on a jack), after the container 1 has been filled with a product, capped and cooled down, in order to compensate for the vacuum generated by the cooling of the product or to increase its internal pressure, and to provide rigidity to the wall portion 5.

Inversion of the diaphragm 11 provokes a liquid displacement (and a subsequent decrease of the inner volume of the container 1 of a volume which is denoted EV and called "extraction volume". The extraction volume EV is comprised between the outwardly-inclined position of the diaphragm 11 and the inwardly-inclined position of the diaphragm 11.

Decreasing the inner diameter D1 of the diaphragm 11 with respect to the outer diameter D2 decreases the extraction volume EV and weakens the stability of the diaphragm 11 in the inwardly-inclined position. On the contrary, increasing the inner diameter D1 of the diaphragm 11 with respect to the outer diameter D2 increases the extraction volume EV and strengthens the stability of the diaphragm 11 in the inwardly-inclined position. However, D1 being too large would result in the container 1 being difficult to mold.

A good compromise is achieved when D1 and D2 are such that their ratio is comprised between about 0.15 and 0.45, and preferably of about 0.25, as depicted on FIG. 2 and FIG. 3:

$$0.15 \leq \frac{D1}{D2} \leq 0.45$$

and, preferably:

$$\frac{D1}{D2} \cong 0.25$$

In another embodiment, D1 and D2 are in a ratio of about 0.35:

$$\frac{D1}{D2} \cong 0.35$$

The container 1 is such designed that, in the inwardly-inclined position, at least an inner portion 16 of the diaphragm 11 adjacent to the inner articulation formed by the inner junction 13 is curved in radial section, with a concavity turned outwards with respect to the container 1. In FIG. 2 and FIG. 3, R1 denotes the radius of curvature of the inner portion 16.

The diaphragm 11 having such a curved inner portion 16, together with the central portion 10, form in the inverted (i.e. inwardly-inclined) position a vault which provides rigidity to the container base 1, the diaphragm 11 being prevented from sinking back. Pressure within the container 1 is thereby maintained to a high value. The container 1 feels rigid when held in hand. In addition, the container 1 provides, when palletized, stability to the pallet.

In order to be inverted the inwardly-inclined position resulting in the curved inner portion 16, the diaphragm 11 is, in the outwardly-inclined position, curved in radial section, with a concavity turned outwards with respect to the container 1.

In a first embodiment illustrated on FIG. 2, the diaphragm 11 has, in the outwardly-inclined position, a radius of curvature—denoted R—which is constant or substantially constant from the outer junction 12 to the inner junction 13.

In a preferred embodiment, R is of about half the outer diameter D2 of the diaphragm 11:

$$R \cong \frac{D2}{2}$$

In the embodiment depicted on FIG. 2, a tangent of the diaphragm 11 to the outer junction 12 is horizontal, i.e. perpendicular to the main axis X of the container 1, in the outwardly-inclined position.

During inversion, the tangent maintains its orientation. Therefore, in the inwardly-inclined position, the diaphragm 11 has an outer portion 17, adjacent to the outer junction 12, which is also curved in radial section, but with a concavity turned inwards with respect to the container 1. In FIG. 2, R2 denotes the radius of curvature of the outer portion 17. The inner portion 16 and the outer portion 17 meet at a median junction 18 which, in radial section, forms an inflexion point between the inner portion 16 and the outer portion 17. In other words, the diaphragm 11 has in radial section a cyma recta shape. Surprisingly, the outer portion 17 does not decrease the rigidity of the diaphragm 11, which remains rigid under the pressure of the content.

In a second embodiment illustrated on FIG. 3, the radius of curvature of the diaphragm 11 has, in the outwardly-inclined position, at least two values. More specifically, the diaphragm 11 has, in the outwardly-inclined position:

an inner portion 19 which, in radial section, is curved with a concavity turned outwards with respect to the container 1, with a radius of curvature denoted R3, and an outer portion 20 which, in radial section, is curved with a concavity turned outwards with respect to the container 1, with a radius of curvature denoted R4, smaller than R3:

$$R4 \leq R3$$

More precisely, R3 and R4 are preferably such that their ratio is comprised between about 0.2 and 1, and more preferably of about 0.30, as depicted on FIG. 3:

$$0.2 \leq \frac{R3}{R4} \leq 1$$

and, preferably:

$$\frac{R3}{R4} \cong 0.3$$

In addition, the inner portion 19 and the outer portion 20 connect at a circular junction 21 having a diameter, denoted D3, such that the ratio of D3 and D2 is comprised between 0.5 and 1, and preferably of about 0.75:

$$0.5 \leq \frac{D3}{D2} \leq 1$$

and, preferably:

$$\frac{D3}{D2} \cong 0.75$$

During inversion of the diaphragm 11 of the second embodiment (FIG. 3), the presence of the inner portion 19 and outer portion 20 permit to obtain:

the inner portion 16 having its concavity turned outwardly with respect to the container 1, the outer portion 17 (R4 and R2 being substantially equal) having a concavity turned inwardly with respect to the container 1.

It shall be noted that, in the embodiment of FIG. 3, the inner portion 16 of the inwardly-inclined position does not necessarily correspond to the inner portion 19 of the outwardly-inclined position; likewise, the outer portion 17 of the inwardly-inclined position does not necessarily correspond to the outer portion 20 of the outwardly-inclined position.

Accordingly, in the inverted position, the diaphragm 11 of the second embodiment of FIG. 3 also has (as in the first embodiment of FIG. 2), in radial section, a cyma recta shape.

The outer portion 20, of smaller radius R4 of curvature, provides rigidity to the diaphragm 11 in the inwardly-inclined position, whereas the inner portion 19 of greater radius R3 of curvature facilitates blow-molding of the container base 7.

In a preferred embodiment depicted in FIG. 3, the outer portion 20 connects to the standing ring 8 (and more specifically to the upper end of the inner wall 15 at the outer junction 12 through an annular ring 22 which, in the outwardly-inclined position, is horizontal (i.e. perpendicular to the main axis X) and which, in the inwardly-inclined position, is frustoconical and inclined inwardly with respect to the container 1, by an angle comprised between 3° and 10° with respect to a horizontal plane. At their junction, the outer portion 20 and the annular ring 22 are preferably tangent.

The annular ring 22 both facilitates inversion of the diaphragm 11 from the outwardly-inclined position to the inwardly-inclined position and prevents the diaphragm 11 from sinking back from the inwardly-inclined position to the outwardly-inclined position after the container 1 has been filled.

In a preferred embodiment depicted in FIG. 3, the central portion 10 may protrude inwardly with respect to the container 1, and include a central disc 23 and a frustoconical outer ring 24 which connects the inner portion 19 of the diaphragm 11 (at the inner junction 13) to the central disc 23.

As illustrated in FIG. 3, the outer ring 24 is preferably inclined, with respect to a vertical line parallel to the main axis X, by an angle denoted A, whereas, at the inner junction 13, the tangent to the inner portion 19 of the diaphragm 11 is inclined with respect to the same vertical line (in the outwardly-inclined position) by an angle denoted B.

As can be seen on FIG. 3, angles A and B are equal (or substantially equal):

$$A \cong B$$

Angle A (and hence angle B) is preferably comprised between 35° and 50°. In the depicted example, angle A is of about 40°.

This facilitates articulation of the inner portion 19 of the diaphragm 11 with respect to the central portion 10 around the inner junction 13, while providing mechanical resistance against sinking of the diaphragm 11 back from its inwardly-inclined position to its outwardly-inclined position.

The invention claimed is:

1. Container (1) made of a plastic material, provided with a base (7) including a standing ring (8) forming a support flange (9) and a diaphragm (11) extending from the standing ring (8) to a central portion (10), said diaphragm (11) being capable of standing in an outwardly-inclined position, wherein the diaphragm (11) connects to the standing ring (8) at an outer junction (12) forming an outer articulation of the diaphragm (11) with respect to the standing ring (8);

wherein the diaphragm (11) connects to the central portion (10) at an inner junction (13) forming an inner articulation of the diaphragm (11) with respect to the central portion (10);

whereby said diaphragm (11) is invertible with respect to the standing ring (8) from the outwardly-inclined position, in which the inner junction (13) extends below the outer junction (12), to an inwardly-inclined position in which the inner junction (13) extends above the outer junction (12);

wherein, in the inwardly-inclined position, at least an inner portion (16) of the diaphragm (11) adjacent to the inner junction (13) is curved in radial section, with a concavity turned outwards with respect to the container (1); and wherein, in the outwardly-inclined position, the diaphragm (11) has an inner portion (19) curved with a concavity turned outwards with respect to the container (1) and having a radius (R3) of curvature, and an outer portion (20) curved with a concavity turned outwards with respect to the container (1) and having a radius (R4) of curvature smaller than the radius (R3) of curvature of the inner portion (19).

2. Container (1) according to claim 1, wherein, in the inwardly-inclined position, an outer portion (17) of the diaphragm (11) adjacent to the outer junction (12) is curved in radial section, with a concavity turned inwards with respect to the container (1).

3. Container (1) according to claim 2, wherein, in the outwardly-inclined position, the diaphragm (11) is curved in radial section, with a concavity turned outwards with respect to the container (1).

4. Container (1) according to claim 2, wherein the standing ring (8) is a high standing ring (8) provided with a frusto-conical inner wall (15) a top end of which forms the outer junction (12), whereby in the outwardly-inclined position the central portion (10) stands above the standing ring (8).

5. Container (1) according to claim 2, wherein the diaphragm (11) has an inner diameter (D1), measured on the inner junction (13), and an outer diameter (D2), measured on the outer junction (12), such that their ratio (D1/D2) is comprised between about 0.15 and about 0.45.

6. Container (1) according to claim 1, wherein, in the outwardly-inclined position, the diaphragm (11) is curved in radial section, with a concavity turned outwards with respect to the container (1).

7. Container (1) according to claim 6, wherein the diaphragm (11) has an outer diameter (D2), measured on the outer junction (12) and wherein, in the outwardly-inclined position, a radius (R) of curvature of the diaphragm is of about half the outer diameter (D2) of the diaphragm.

8. Container (1) according to claim 6, wherein the standing ring (8) is a high standing ring (8) provided with a frusto-conical inner wall (15) a top end of which forms the outer junction (12), whereby in the outwardly-inclined position the central portion (10) stands above the standing ring (8).

9. Container (1) according to claim 6, wherein the diaphragm (11) has an inner diameter (D1), measured on the inner junction (13), and an outer diameter (D2), measured on the outer junction (12), such that their ratio (D1/D2) is between about 0.15 and about 0.45.

10. Container (1) according to claim 1, wherein the standing ring (8) is a high standing ring (8) provided with a frusto-conical inner wall (15) a top end of which forms the outer junction (12), whereby in the outwardly-inclined position the central portion (10) stands above the standing ring (8).

11. Container (1) according to claim 10, wherein the diaphragm (11) has an inner diameter (D1), measured on the inner junction (13), and an outer diameter (D2), measured on the outer junction (12), such that their ratio (D1/D2) is between about 0.15 and about 0.45.

12. Container (1) according to claim 1, wherein the diaphragm (11) has an inner diameter (D1), measured on the inner junction (13), and an outer diameter (D2), measured on the outer junction (12), such that their ratio (D1/D2) is between about 0.15 and about 0.45.

13. Container (1) according to claim 12, wherein the inner diameter (D1) and the outer diameter (D2) of the diaphragm (11) are such that their ratio (D1/D2) is about 0.35.

14. Container (1) according to claim 1, wherein the respective radiuses (R3, R4) of curvature of the inner portion (19) and outer portion (20) of the diaphragm (11) are such that their ratio (R3/R4) is between about 0.2 and 0.4.

15. Container (1) according to claim 1, wherein the outer portion (20) of the diaphragm (11) connects to the standing ring (8) through an annular ring (22).

16. Container (1) according to claim 1, wherein the central portion (10) has a central disc (23) and a frustoconical outer ring (24) which connects the inner portion (19) of the diaphragm (11) to the central disc (23), wherein the outer ring (24) is inclined, with respect to a line parallel to a main axis (X) of the container, by an angle A, and wherein, at the inner junction (13), a tangent to the inner portion (19) of the diaphragm (11) is inclined with respect to said line, in the outwardly-inclined position, by an angle B substantially equal to angle A.

* * * * *